US008574015B2

(12) United States Patent
Tai et al.

(10) Patent No.: US 8,574,015 B2
(45) Date of Patent: Nov. 5, 2013

(54) ELECTRICAL CONNECTOR

(75) Inventors: Hung-Chi Tai, Jhonghe (TW); Hai-Lang Wang, Taicang (CN)

(73) Assignee: Alltop Electronics (Suzhou) Ltd., Taicang (CN)

( * ) Notice: Subject to any disclaimer, the term of this patent is extended or adjusted under 35 U.S.C. 154(b) by 8 days.

(21) Appl. No.: 13/409,567

(22) Filed: Mar. 1, 2012

(65) Prior Publication Data

US 2013/0171856 A1 Jul. 4, 2013

(30) Foreign Application Priority Data

Jan. 4, 2012 (CN) ..... 2012 1 0000887

(51) Int. Cl.
*H01R 13/10* (2006.01)

(52) U.S. Cl.
USPC ..... 439/682; 439/79; 439/908

(58) Field of Classification Search
USPC ..... 439/682, 79, 908
See application file for complete search history.

(56) References Cited

U.S. PATENT DOCUMENTS

| | | | | |
|---|---|---|---|---|
| 5,413,491 | A * | 5/1995 | Noschese | 439/108 |
| 5,549,480 | A * | 8/1996 | Cheng | 439/79 |
| 7,059,919 | B2 * | 6/2006 | Clark et al. | 439/825 |
| 7,153,171 | B1 * | 12/2006 | Goto | 439/699.2 |
| 7,867,045 | B2 * | 1/2011 | McAlonis | 439/891 |
| 7,946,871 | B1 * | 5/2011 | Yu et al. | 439/181 |
| 7,980,860 | B2 * | 7/2011 | Yu et al. | 439/65 |
| 8,057,266 | B1 * | 11/2011 | Roitberg | 439/682 |
| 2008/0064264 | A1 * | 3/2008 | Clark et al. | 439/626 |
| 2012/0289071 | A1 * | 11/2012 | Dodds et al. | 439/183 |
| 2013/0040500 | A1 * | 2/2013 | Ngo | 439/660 |

* cited by examiner

*Primary Examiner* — James Harvey
(74) *Attorney, Agent, or Firm* — Sughrue Mion, PLLC

(57) ABSTRACT

An electrical connector includes an elongated insulating housing defining a number of passageways and power terminals received in corresponding passageways. The passageways are arranged side by side along a longitudinal direction of the insulating housing. Each power terminal has a first terminal and a second terminal oppositely arranged beside the first terminal. The first terminal has a first contacting portion, a first fixing portion extending towards the second terminal, and a first connecting portion connecting the first contacting portion and the first fixing portion. The second terminal has a second contacting portion oppositely arranged beside the first contacting portion of the first terminal. A curved intermediate region is formed between the first connecting portion and the first contacting portion of the first terminal. A width of the first fixing portion is larger than a distance between the first contacting portion and the second contacting portion.

16 Claims, 5 Drawing Sheets

ELECTRICAL CONNECTOR

BACKGROUND OF THE INVENTION

1. Field of the Invention

The present invention relates to an electrical connector, and more particularly to an electrical connector connectable with a cable.

2. Description of Related Art

Generally, a conventional power connector includes an insulating housing and a plurality of power contacts received in the insulating housing. With the development of the industry, large current is more desired to be used in the electrical devices, which in turn, the design issue of how to dissipate such a large amount of heat needs to confront. In the meanwhile, changing of the power contact of the connector is also another design issue needed to be cared.

Hence, an electrical connector with improved structure to settle above-described design issues is desired.

BRIEF SUMMARY OF THE INVENTION

The present invention provides an electrical connector for connecting to a cable with a plurality of wires. The electrical connector comprises an elongated insulating housing defining a plurality of passageways and a plurality of power terminals received in corresponding passageways. The plurality of passageways is arranged side by side along a longitudinal direction of the insulating housing. Each power terminal comprises a first terminal and a second terminal oppositely arranged beside the first terminal. The first terminal has a first contacting portion, a first fixing portion extending towards the second terminal along a perpendicular direction to the first contacting portion, and a first connecting portion connecting the first contacting portion and the first fixing portion. The second terminal has a second contacting portion oppositely arranged besides the first contacting portion of the first terminal. A curved intermediate region is formed between the first connecting portion and the first contacting portion of the first terminal. A width of the first fixing portion is larger than a distance between the first contacting portion and the second contacting portion.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
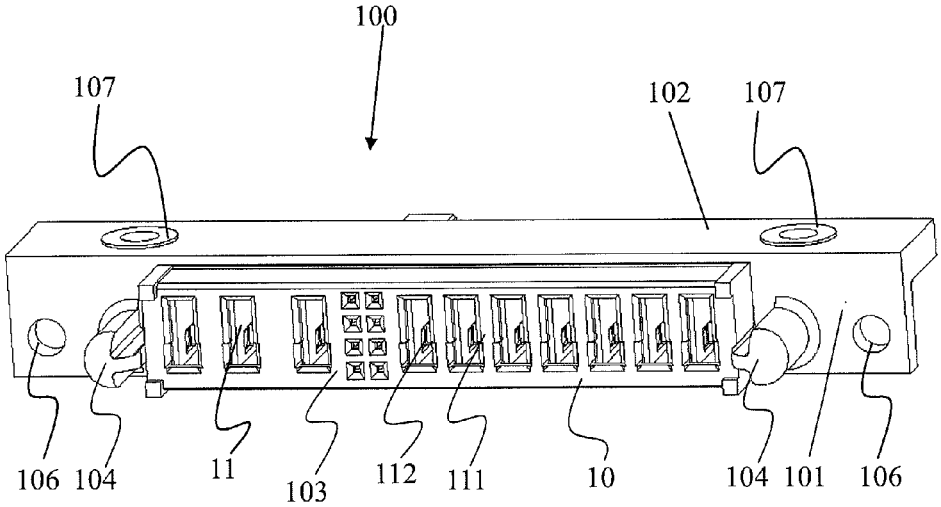
FIG. 1 is a perspective view of an electrical connector in accordance with the present invention.

Reference will now be made to the drawing figures to describe the embodiments of the present invention in detail. In the following description, the same drawing reference numerals are used for the same elements in different drawings.

Figure 2:
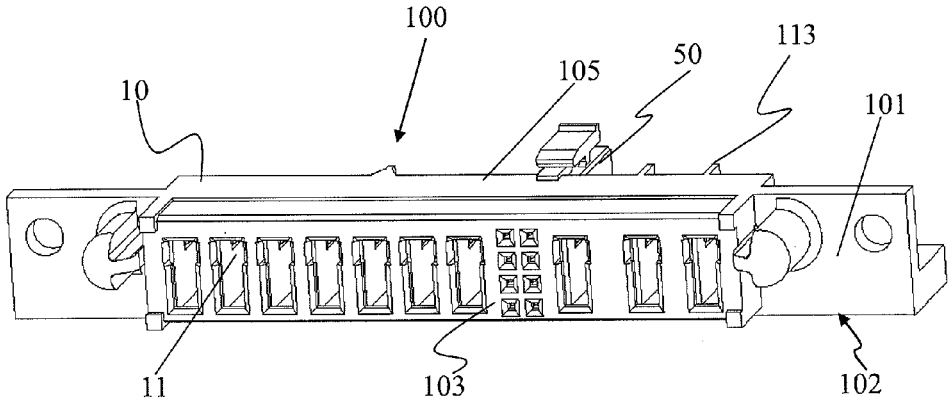
FIG. 2 is a perspective view similar to FIG. 1 while taken from another aspect.
Figure 3:
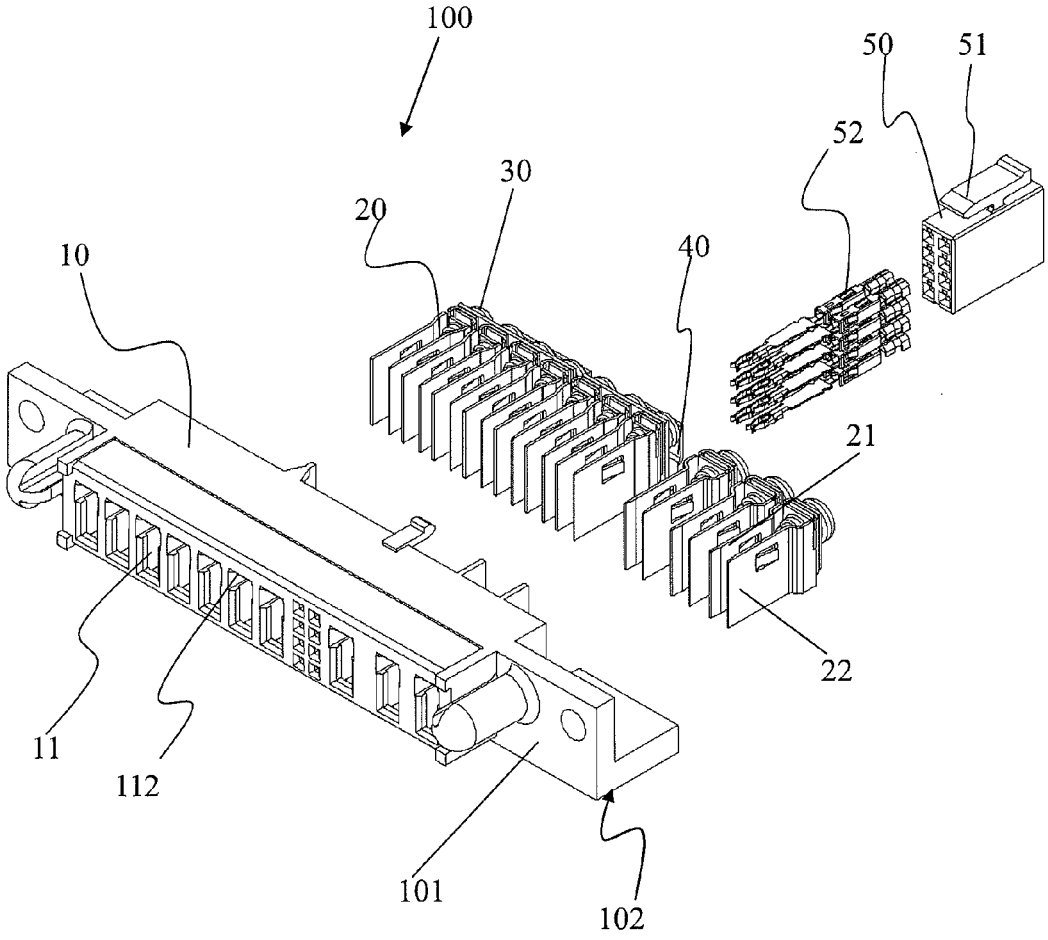
FIG. 3 is an exploded perspective view of the electrical connector shown in FIG. 1.

Referring to FIGS. 1-3, an electrical connector 100 in accordance with the present invention, which is configured to connect with a cable (not shown), comprises an elongated insulating housing 10, a plurality of power terminals 20 assembled in the insulating housing 10, a plurality of bus bars 40 selectively connecting the power terminals 20, and a signal terminal module 50 assembled to the insulating housing 10 for transmitting signals. In the preferred embodiment, the electrical connector 100 comprises ten power terminals 20 and two bus bars 40. The power terminals 20 and corresponding bus bars 40 are arranged at opposite sides of the signal terminal module 50 along a transversal direction of the electrical connector 100. There are seven power terminals 20 arranged on one side of the signal terminal module 50, and three power terminals 20 arranged on the other side of the signal terminal module 50. One of the bus bars 40 connects simultaneously with three power terminals 20. One of the bus bars 40 connects simultaneously with the rest four power terminals 20. As can be understood, the number and the connecting methods of the terminals and the bus bars in other embodiments can be different according to application requirements.

Referring together to FIGS. 1-4, the insulating housing 10 defines a first plate 101 and a second plate 102 perpendicular to the first plate. The electrical connector 100 can be vertically mounted to a device (not shown) with the first plate 101 engaging with the device. The electrical connector 100 can be also vertically mounted to the device with the second plate 102 engaging with said device. The insulating housing 10 comprises a mating section 103 extending forwardly from the first plate 101 adapted to engage with a complementary connector (not shown), a pair of guiding posts 104 positioned at opposite sides of the mating section 103, and a mounting section 105 extending rearwards from the first plate 101. A pair of through-holes 106 is defined on the first plate 101, from which the insulating housing 10 is secured to the device. A pair of holes 107 is oppositely defined through the second plate 102. The insulating housing 10 can be horizontally assembled to the device via the hole 107 of the second plate 102.

A plurality of passageways 11, which are adapted for receiving the power terminals 20, extend through the insulating housing 10 along a front-to-back direction. The plurality of passageways 11 are arranged side-by-side along a longitudinal direction of the insulating housing 10. The insulating housing 10 provides a plurality of dividing walls 111 separating the plurality of passageways 11. Each dividing wall 111 defines a groove 112 at opposite sides thereof, through which a heat transmission purpose can be achieved. The groove 112 extends along the front-to-back direction. In the preferred embodiment, the groove 112 does not extend throughout the dividing wall 111. In other words, the groove 112 is not opened to the outside from a rear edge of the dividing wall 111. While, in other applications, the groove 112 can be any shape with or without extending throughout the dividing wall. A plurality of separating plates 113 extends from a rear edge of the insulating housing 10. The separating plates 113 are used to separate exposed sections of each two adjacent power terminals 20.

Figure 4:
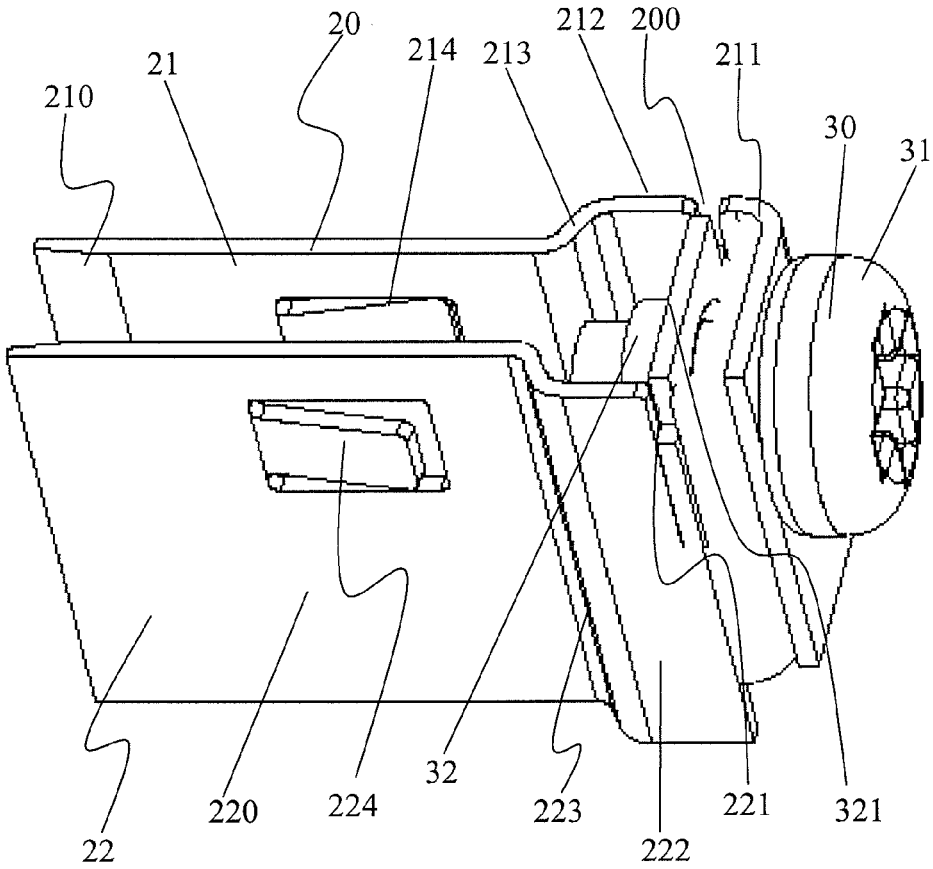
FIG. 4 is a perspective view of a power terminal of the electrical connector.
Figure 5:
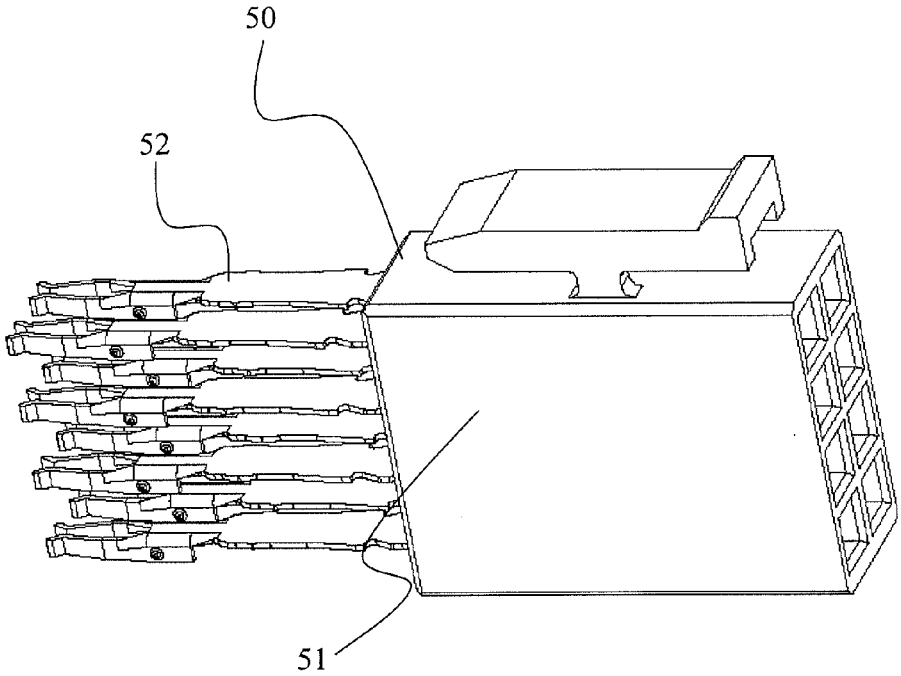
FIG. 5 is a perspective view of a signal terminal module of the electrical connector.
Figure 6:
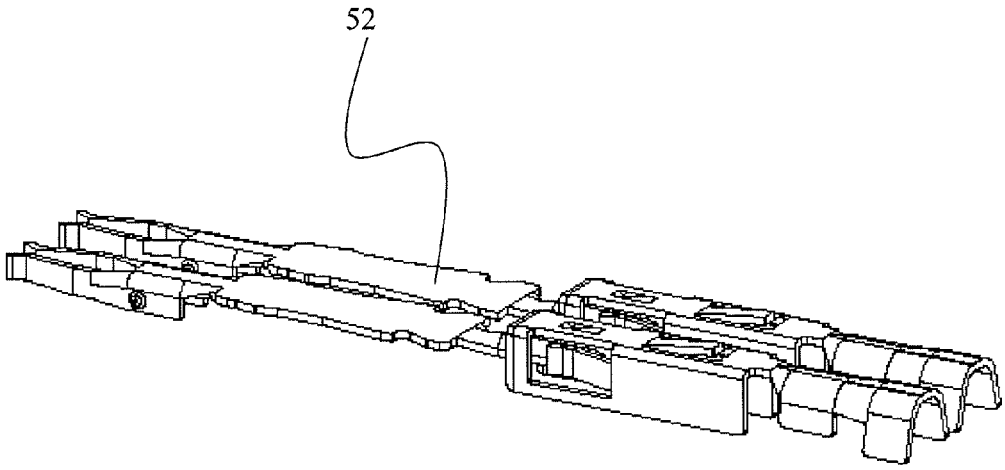
FIG. 6 is a perspective view of signal terminals of the electrical connector.

Together referring to FIGS. 4-6, the power terminal 20 includes a first terminal 21 and an opposite second terminal 22. The first terminal 21 has a planar, first contacting portion 210 for electrically connecting with corresponding contacts of the complementary connector, a first fixing portion 211 extending towards the second terminal 22 along a perpendicular direction to the first contacting portion 210, a first connecting portion 212 connecting the first contacting portion 210 and the first fixing portion 211, and a curved intermediate region 213 formed between the first connecting portion 212 and the first contacting portion 210. Similarly, in the preferred embodiment, the second terminal 22 has a similar construction with the first terminal 21. The second terminal 22 has a second contacting portion 220 parallel to the first contacting portion 210, a second fixing portion 221 extending towards the first terminal 21 along a perpendicular direction to the second contacting portion 220, a second connecting portion 222 connecting the second contacting portion 220 and the second fixing portion 221, and a curved intermediate region 223 formed between the second fixing portion 221 and the second contacting portion 220. Both the first contacting portion 210 and the second contacting portion 220 define a tab 214, 224 extending outwards along the front-to-back direction to thereby secured in the groove 112 of the insulating housing 10. The first and the second fixing portions 211, 221 are overlapped with each other to thereby forming the power terminal 20 as whole. In the preferred embodiment, the first fixing portion 211 is formed as a planar blade shape. While, as can be understood, other shapes are applicable to the first fixing portion 211. A width of the first fixing portion 211 is larger than a distance between the first contacting portion 210 of the first terminal 21 and the second contacting portion 220 of the second terminal 22. In such a configuration, a large contacting are is provided which in turn improves the effect of current transmission. In other embodiment, the second terminal 22 can be integratedly formed with the first terminal 21 with only the second contacting portion 220 formed thereon.

The electrical connector 100 also comprises a plurality of locking devices 30 adapted for securedly connecting the first terminal 21 and the second terminal 22. The locking device 30 includes a first locking element 31 and a second locking element 32. The first locking element 31 extends through the first and the second fixing portions 211, 221. The second locking element 32 is arranged opposite to the first locking element 31 and engageable to the first locking element 31. The second locking element 32 is received in a receiving space (not labeled) defined between the two curved intermediate regions 213, 223. In the preferred embodiment, the first and the second fixing portions 211, 221 define a hole (not shown) extending therethrough for insertion of the locking device 30. The first locking element 31 extends through the first and the second fixing portions 211, 221, and the second locking element 32 engages with the first locking element 31 from a side opposite to the insertion direction to thereby sandwich the fixing portions 211, 221 therebetween. In the preferred embodiment, the first locking element 31 can be a bolt, and the second locking element 32 can be a nut screwed to the bolt. While, in other embodiment, the locking elements 31, 32 can be other shapes or configurations. Both the first connecting portion 212 and the second connecting portion 222 define a slit 200 on an edge thereof, respectively. A gasket 321 is received within the slits 200 for facilitate secure the second locking element 32 to the power terminal 20.

In the meanwhile, the locking device 30 locks the bus bar 40 with corresponding power terminals 20. Still, in other embodiment, the locking device 30 can be tin solder.

During assembly, the power terminal 20 are inserted into corresponding passageways 11 of the insulating housing 10 from a rear side thereof in a back-to-front direction. The tabs 214, 224 of the power terminals 20 are then secured within the grooves 112 to thereby secure the first terminal 21 and the second terminal 22 in the passageway 11. A heat transmission space is defined between the dividing walls 111 and corresponding first and second contacting portions 210, 220 via such a grooves 112. Also, the arrangement of the grooves 112 save the cost of the material to some extends. Besides, when the power terminal 20 is needed to be changed, the external tool can be inserted into the passageway through the groove, which rejects the power terminal from the groove. In the preferred embodiment, a plurality of barbs (not shown) can be formed along the edges of the first contacting portion 210 and the edges of the second contacting portion 220 to help to secure the power terminal in the passageway 11.

Figure 7:
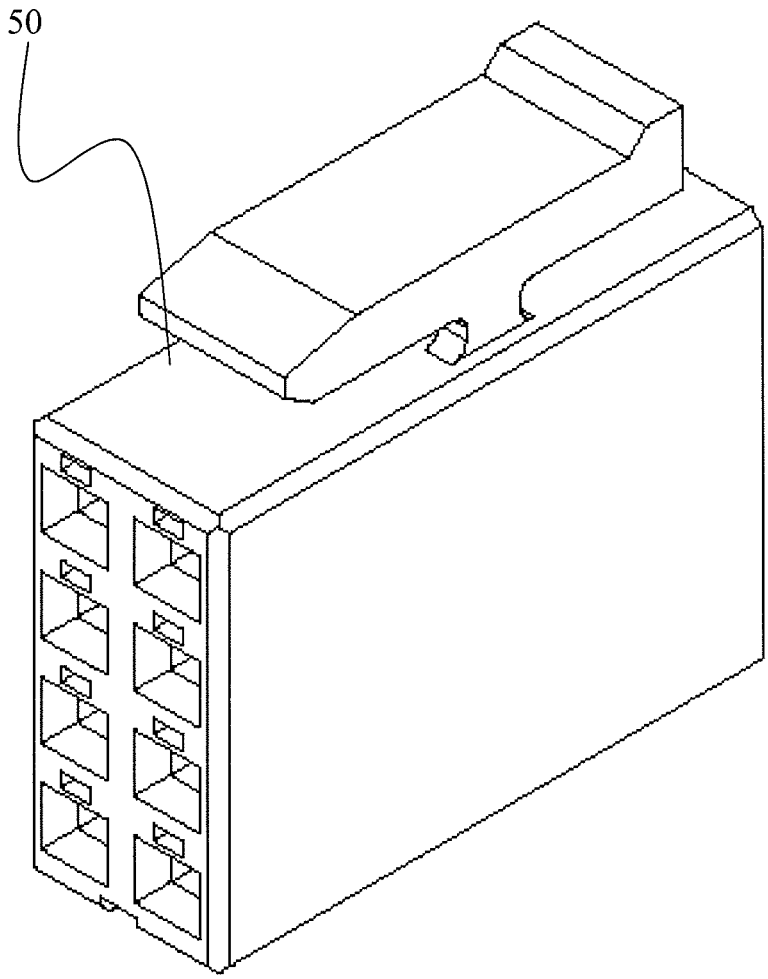
FIG. 7 is a perspective view of an insulator of the signal terminal module.

Referring to FIGS. 5-7, the signal terminal module 50 of the electrical connector 100 is changeably assembled to the insulating housing 10. The signal terminal module 50 includes an insulator 51 and a plurality of signal terminals 52 retained in the insulator 51.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector terminated with a plurality of cables having wires, comprising:

an elongated insulating housing, said elongated insulating housing defining a plurality of passageways extending therethrough, said plurality of passageways arranged side by side along a longitudinal direction of said insulating housing; and a plurality of power terminals received in corresponding passageways, each power terminal comprising a first terminal and a second terminal oppositely arranged beside said first terminal, said first terminal having a first contacting portion, a first fixing portion extending towards said second terminal along a perpendicular direction to said first contacting portion, and a first connecting portion connecting said first contacting portion and said first fixing portion, said second terminal having a second contacting portion oppositely arranged besides said first contacting portion of said first terminal;

wherein a curved intermediate region is formed between said first connecting portion and said first contacting portion of said first terminal;

wherein a locking device is adapted for secured connecting of said first terminal and said second terminal;

wherein a width of said first fixing portion is larger than a distance between said first contacting portion and said second contacting portion.

2. The electrical connector as claimed in claim 1, wherein said second terminal further comprises a second fixing portion and a second connecting portion interconnecting said second contacting portion with said second fixing portion.

3. The electrical connector as claimed in claim 2, wherein a curved intermediate region is formed between said second connecting portion and said second contacting portion of said first terminal.

4. The electrical connector as claimed in claim 3, wherein a receiving space is defined between said curved intermediate regions of said first and said second terminals.

5. The electrical connector as claimed in claim 1, further comprising a signal terminal module assembled to said insulating housing for signal transmission.

6. The electrical connector as claimed in claim 4, wherein said locking device comprises a first locking element extending through said first and said second fixing portions, and a second locking element arranged opposite to said first locking element and engageable to said first locking element, and wherein said second locking element is received in said receiving space between said two curved intermediate regions.

7. The electrical connector as claimed in claim 6, wherein both of said first connecting portion and said second connecting portion define a slit, respectively, which is adapted to accommodating therein a gasket, and wherein said gasket is assembled to said second locking element to facilitate securing said second locking element on said power terminal.

8. The electrical connector as claimed in claim 1, wherein said insulating housing provides a plurality of dividing walls between each two adjacent passageways.

9. The electrical connector as claimed in claim 8, wherein each dividing wall defines a groove on opposite side faces thereof, and wherein each groove extends along a front-to-back direction for heat transmitting.

10. The electrical connector as claimed in claim 9, wherein said first terminal and said second terminal each forms a tab stamped from said first/second contacting portion, and wherein said tab extends outwards along a front-to-back direction.

11. The electrical connector as claimed in claim 10, wherein said tab is retained within said groove of said dividing wall to thereby secure said power terminal, and wherein a tool can be inserted into said groove to reject said first/second terminal from said groove.

12. The electrical connector as claimed in claim 1, further comprising a bus bar connecting said plurality of power terminals.

13. The electrical connector as claimed in claim 1, wherein said insulating housing provides a plurality of separating plates extending from a rear edge thereof along an insertion direction of said power terminals.

14. The electrical connector as claimed in claim 1, wherein said insulating housing defines a first plate and a second plate perpendicular to said first plate.

15. The electrical connector as claimed in claim 14, wherein said electrical connector is vertically mounted to a device with said first plate engaging with said device.

16. The electrical connector as claimed in claim 14, wherein said electrical connector is horizontally mounted to a device with said second plate engaging with said device.

* * * * *